US010053889B1

(12) United States Patent
Maratos

(10) Patent No.: US 10,053,889 B1
(45) Date of Patent: Aug. 21, 2018

(54) KEY AND CABLE-STYLE LOCK

(71) Applicant: Peter Maratos, Lyman, SC (US)

(72) Inventor: Peter Maratos, Lyman, SC (US)

( * ) Notice: Subject to any disclaimer, the term of this patent is extended or adjusted under 35 U.S.C. 154(b) by 0 days.

(21) Appl. No.: 15/652,355

(22) Filed: Jul. 18, 2017

(51) Int. Cl.
*E05B 45/06* (2006.01)
*E05B 45/00* (2006.01)
*E05B 71/00* (2006.01)
*E05B 73/00* (2006.01)

(52) U.S. Cl.
CPC ..... *E05B 45/005* (2013.01); *E05B 45/06* (2013.01); *E05B 71/00* (2013.01); *E05B 73/0005* (2013.01)

(58) Field of Classification Search
CPC ..... G08B 13/1445; G08B 13/1454; G08B 13/1463; B62H 5/00; B62H 5/20; B62H 5/003; E05B 45/00; E05B 45/005; E05B 45/06; E05B 71/00; E05B 73/0005
USPC ..... 340/542, 432, 427
See application file for complete search history.

(56) References Cited

U.S. PATENT DOCUMENTS 5,200,735 A * 4/1993 Hines ..... G08B 25/10 340/539.11
5,408,212 A * 4/1995 Meyers ..... B62H 5/20 340/432
D390,771 S 2/1998 Egger
6,043,733 A * 3/2000 Lind ..... B60R 25/102 340/427
7,543,467 B2 * 6/2009 Sheehan ..... E05B 45/005 340/542
7,726,160 B2 * 6/2010 Gagosz ..... B62H 3/00 70/49
7,855,642 B2 * 12/2010 Veiga, III ..... G08B 25/08 340/539.1
8,207,852 B2 6/2012 Oehlert
8,228,192 B2 7/2012 Eckert
9,013,301 B2 4/2015 Williams
9,260,885 B2 2/2016 Asquith
9,512,649 B2 12/2016 Mohamed
2015/0137975 A1 * 5/2015 Maggi ..... E05B 45/005 340/572.1
2015/0204112 A1 7/2015 Salzmann et al.

FOREIGN PATENT DOCUMENTS

WO 2016048421 A 3/2016

* cited by examiner

*Primary Examiner* — Thomas Mullen

(57) ABSTRACT

The key and cable-style lock is an alarm system that is configured for use with a cycle selected from the group consisting of a bicycle or motorcycle. The key and cable-style lock: 1) anchors the cycle to an anchor point to prevent the unauthorized use of the cycle; and, 2) generates a notification to an appropriate authority when the key and cable-style lock is compromised. The key and cable-style lock comprises a lock and a control circuit. The lock anchors the cycle to the selected anchor point. The control circuit monitors the lock and

10 Claims, 5 Drawing Sheets

KEY AND CABLE-STYLE LOCK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transporting including land vehicles, more specifically, a device incorporating a cable that indicates and prevents the unauthorized use of a cycle.

SUMMARY OF INVENTION

The key and cable-style lock is an alarm system that is configured for use with a cycle selected from the group consisting of a bicycle or motorcycle. The key and cable-style lock: 1) anchors the cycle to an anchor point to prevent the unauthorized use of the cycle; and, 2) generates a notification to an appropriate authority when the key and cable-style lock is compromised. The key and cable-style lock comprises a lock and a control circuit. The lock anchors the cycle to the selected anchor point. The control circuit monitors the lock and generates the notification to the appropriate authority.

These together with additional objects, features and advantages of the key and cable-style lock will be readily apparent to those of ordinary skill in the art upon reading the following detailed description of the presently preferred, but nonetheless illustrative, embodiments when taken in conjunction with the accompanying drawings.

In this respect, before explaining the current embodiments of the key and cable-style lock in detail, it is to be understood that the key and cable-style lock is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the key and cable-style lock.

It is therefore important that the claims be regarded as including such equivalent construction insofar as they do not depart from the spirit and scope of the key and cable-style lock. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
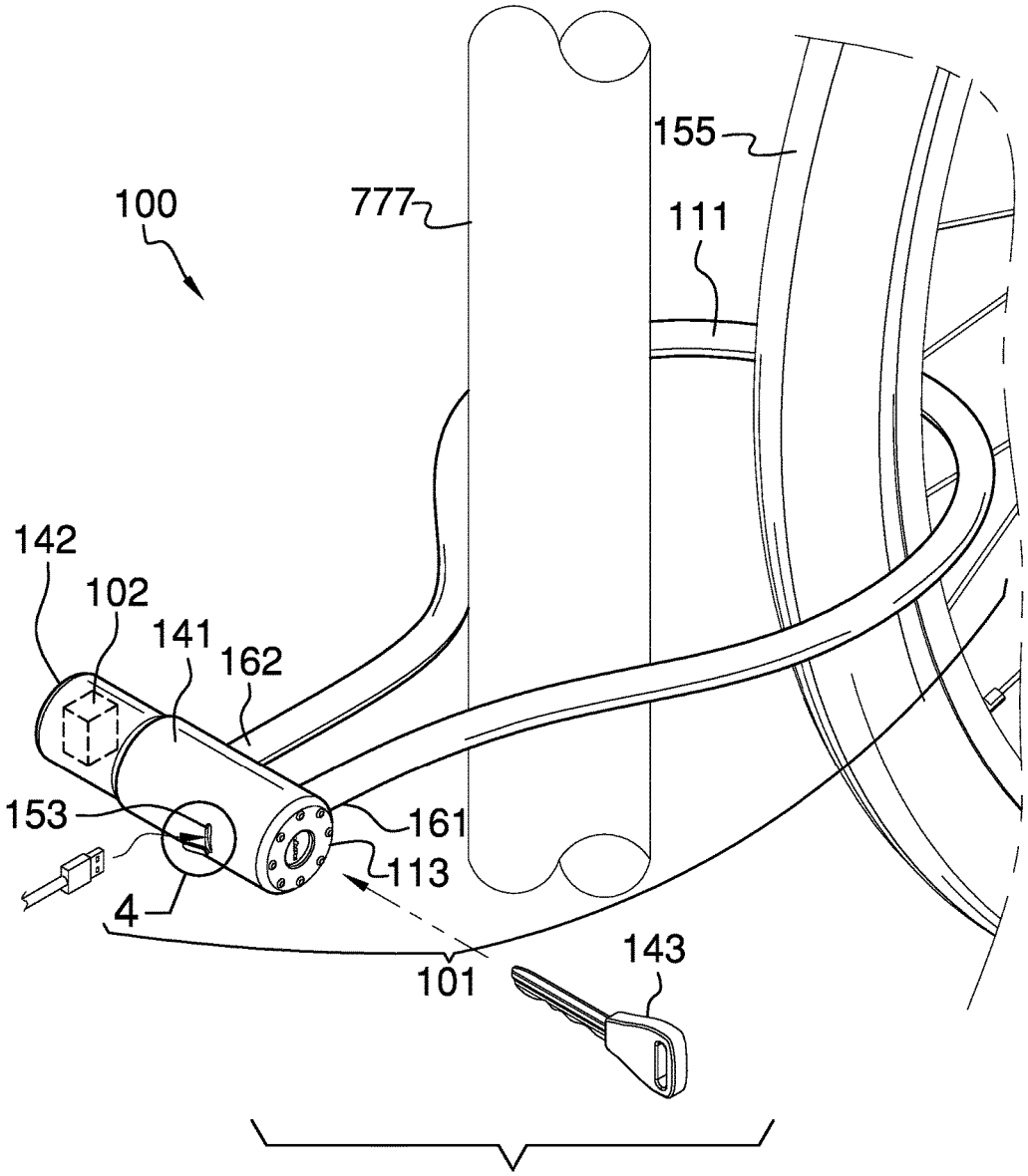
FIG. 1 is a perspective view of an embodiment of the disclosure.
Figure 2:
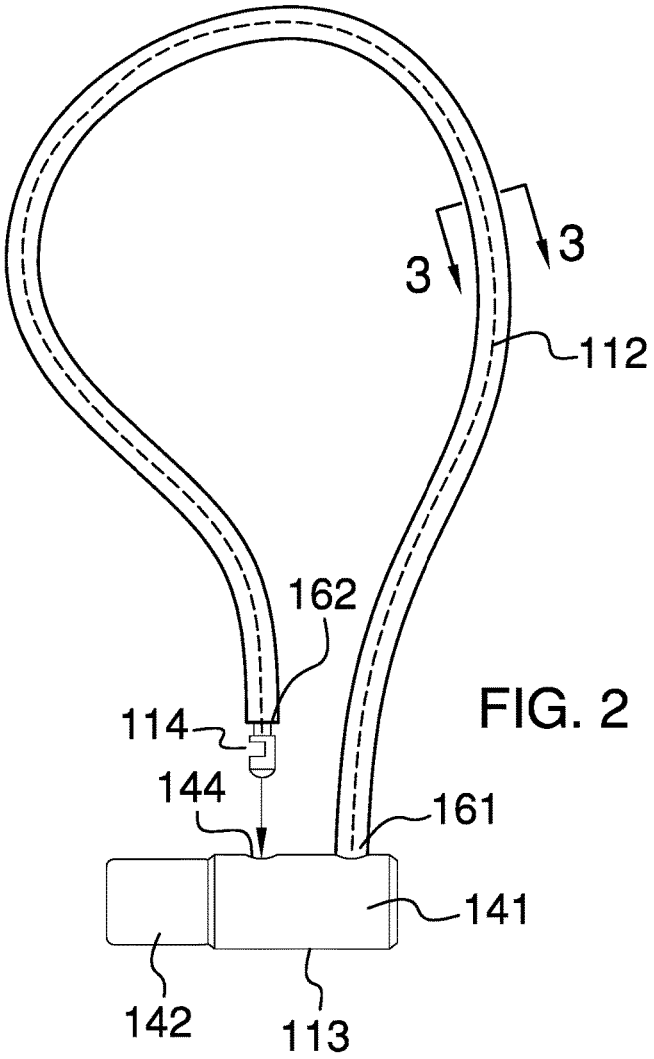
FIG. 2 is a front view of an embodiment of the disclosure.
Figure 3:
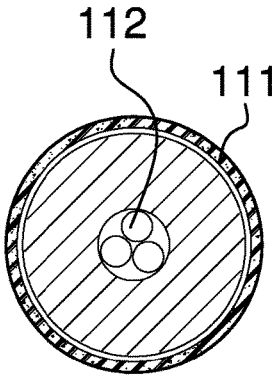
FIG. 3 is a cross-sectional view of an embodiment of the disclosure across 3-3 as shown in FIG. 2.
Figure 4:
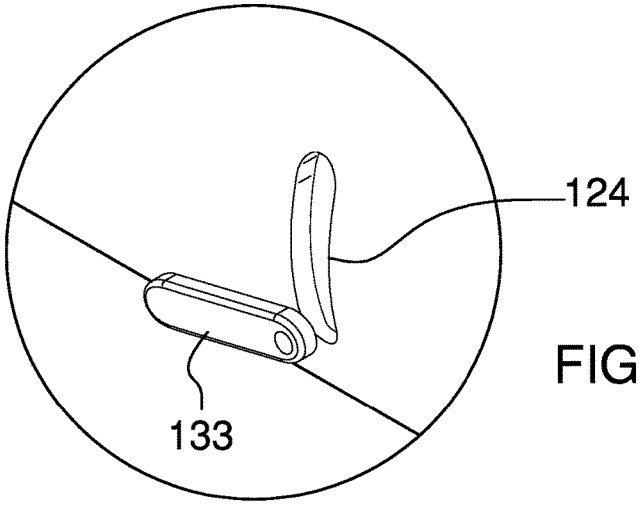
FIG. 4 is a detail view of an embodiment of the disclosure.
Figure 5:
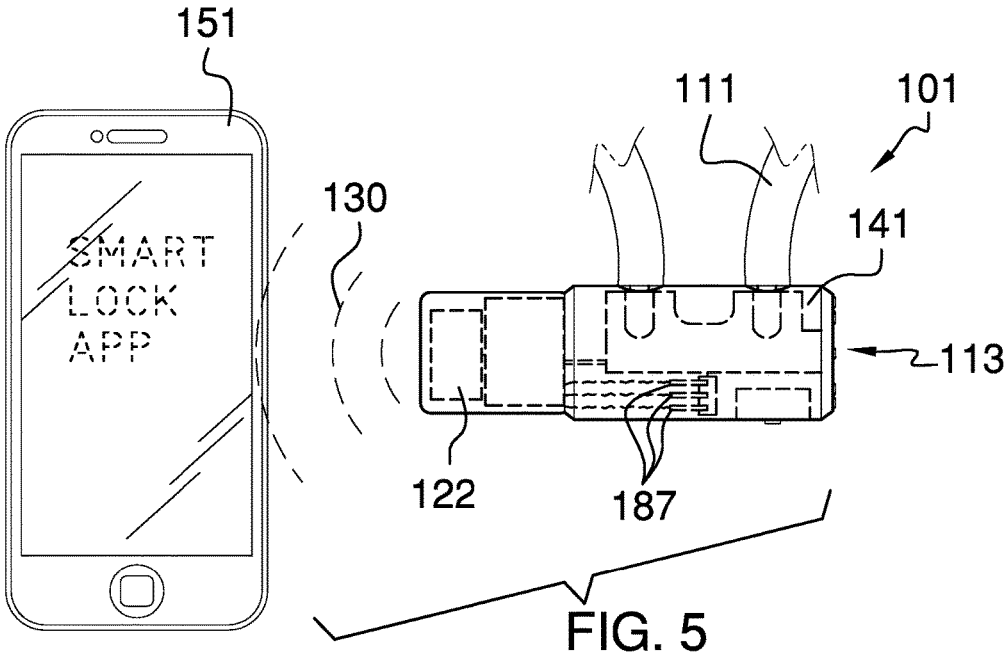
FIG. 5 is an in use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The key and cable-style lock 100 (hereinafter invention) is an alarm system that is configured for use with a cycle 155 selected from the group consisting of a bicycle 155 or motorcycle 155. The invention 100: 1) anchors the cycle 155 to an anchor point 777 to prevent the unauthorized use of the cycle 155; and, 2) generates a notification to an appropriate authority 154 when the invention 100 is compromised. The invention 100 comprises a lock member 101 and a control system 102. The control system 102 attaches to the lock member 101. The lock member 101 anchors the cycle 155 to the selected anchor point 777. The control system 102 monitors the lock member 101 and generates the notification to the appropriate authority 154. The appropriate authority 154 refers to an individual who is identified to receive notifications from the control system 102.

The lock member 101 is a physical security device. The lock member 101: 1) physically anchors the cycle 155 to an anchor point 777; or, 2) physically incapacitates the cycle 155. The lock member 101 comprises a security cable 111, a cable continuity wire 112, and a lock 113.

The security cable 111 is a flexible cable that is commonly referred to as a security cable. The security cable 111 is formed from a hardened steel. The security cable 111 binds the cycle in a manner selected from the group consisting of: 1) anchoring the cycle 155 to an anchor point 777; or, 2) binding the wheel of the cycle 155 to itself for the purpose of incapacitating the cycle 155. The security cable 111 comprises a hook 114. The security cable 111 is further defined with a first end 161 and second end 162.

The hook 114 is a structure that attaches to the second end 162 of the security cable 111. The hook 114 is removably inserted into the lock 113. The lock 113 attaches itself to the hook 114 and remains attached until the lock 113 is released.

The cable continuity wire 112 is an electrically conductive wire that is incorporated into the security cable 111. The cable continuity wire 112 is a sensor that detects tampering with the security cable 111. Specifically, the control system 102 monitors an electrical current that the control system 102 sends through the cable continuity wire 112. The theory of operation of the invention 100 makes the assumption that if the security cable 111 is damaged then the cable continuity wire 112 has also been damaged such that the cable continuity wire 112 will no longer be able to conduct electricity which will disrupt the electric current sent through the cable continuity wire 112 by the control system 102. The control system 102 detects the interruption of the electric current through the cable continuity wire 112 and responds to this interruption by sending a notification to the appropriate authority 154.

The lock 113 is a fastening device that attaches the first end 161 of the security cable 111 to the second end 162 of the security cable 111 in a manner that forms a loop 145. The loop 145 formed by the lock 113 is used to secure the cycle 155. The lock 113 comprises a tumbler housing 141, a circuit housing 142, a key 143, and a hook slot 144.

The tumbler housing 141 is a first rigid structure within which tumblers 187 of the lock 113 are contained. The key 143 is inserted into the tumbler housing 141 to adjust the tumblers 187 between a locked position and an unlocked position. The circuit housing 142 is a second rigid structure within which the control system 102 is contained. The key 143 is a device that is inserted into and rotated within the tumbler housing 141 for the purpose of locking and unlocking the lock 113. The hook slot 144 is an aperture that is formed within the tumbler housing 141. The hook 114 is keyed to the hook slot 144 such that the hook 114 is secured within the hook slot 144 when the lock 113 is in the locked position.

The first end 161 of the security cable 111 is permanently attached to the tumbler housing 141. The second end 162 of the security cable 111 is wrapped around the cycle 155 and is secured to the lock 113.

The control system 102 is an electrically powered device that: 1) monitors the lock 101 for tampering; and, 2) upon detecting tampering sends a wireless notification to an appropriate authority 154 informing the appropriate authority 154 about the tampering. The control system 102 comprises a logic module 120, a first communication module 121, a second communication module 122, a battery 123, a charging port 124, a diode 125, a key switch 126, a hook switch 127, an electrical ground 128, a first wireless communication link 129, a second wireless communication link 130, a first pull up resistor 131, a second pull up resistor 132, and a port cover 133. The electrical ground 128 is a reference voltage that is used throughout the control system 102.

The logic module 120 is a readily and commercially available programmable electronic device that is used to manage, regulate, and operate the control system 102. Depending on the specific design and the selected components, the logic module 120 can be a separate component within the control system 102 or the functions of the logic module 120 can be incorporated into another component within the control system 102. The logic module 120 generates and monitors the electrical current that flows through the cable continuity wire 112.

The first communication module 121 is a wireless electronic communication device. The first communication module 121 communicates SMS and MMS messages between the logic module 120 and the appropriate authority 154 through a commercially provided and publicly available cellular wireless network 152. The first communication module 121 uses a first wireless communication link 129 to communicate with the commercially provided and publicly available cellular wireless network 152. The use of a commercially provided and publicly available cellular wireless network 152 is preferred because: 1) of its low cost; 2) of the widespread availability and the broad interoperability between competing commercially provided and publicly available cellular wireless networks 152; and, 3) methods and techniques to send SMS and MMS messages over a commercially provided and publicly available cellular wireless network 152 are well known and documented by those skilled in the electrical arts. An example of a commercially provided and publicly available cellular wireless network 152 is a network used for cellular phones.

The second communication module 122 is a wireless electronic communication device that allows the logic module 120 to wirelessly communicate with the appropriate authority 154 through a locally presented device such as a personal data device 151. The personal data device 151 is an electronic device that is carried by the appropriate authority 154. Specifically the second communication module 122 establishes a second wireless communication link 130 between the control system 102 and the personal data device 151 or other locally presented device. In the second potential embodiment of the disclosure the second communication module 122 supports a WiFi communication protocol.

The battery 123 is a commercially available rechargeable battery 123. The chemical energy stored within the battery 123 is renewed and restored through use of the charging part 124. The charging port 124 is an electrical circuit that reverses the polarity of the battery 123 and provides the energy necessary to reverse the chemical processes that the battery 123 initially used to generate the electrical energy. This reversal of the chemical process creates a chemical potential energy that will later be used to generate electricity. The charging port 124 attaches to an external power source from which it draws electrical energy. In the first potential embodiment of the disclosure, the external power source is a USB compliant voltage source that attaches to the charging port 124 using a plug 153. The plug 153 refers to an electrical termination that provides power to the battery 123.

The diode 125 is an electrical device that allows current to flow in only one direction. The diode 125 is installed between the battery 123 and the charging port 124 such that electricity will not flow from the positive terminal of the battery 123 to the positive terminal of the charging port 124.

The key switch 126 is a normally closed momentary switch that detects the presence of the key 143 in the tumbler housing 141. The key switch 126 is monitored by the logic module 120. When the key 143 is inserted into the tumbler housing 141, the key switch 126 is opened and this opening disables the control system 102. The hook switch 127 is a normally open momentary switch that detects the presence of the hook 114 in the hook slot 144. The hook switch 127 is monitored by the logic module 120. When the hook 114 is inserted into the hook slot 144, the hook switch 127 is closed and this closure is detected by the logic module 120.

The theory of operation of the invention 100 makes the assumption that the hook switch 127 will always be inserted into the hook slot 144 unless the key 143 is inserted into the tumbler housing 141. If the hook 114 is removed from the hook slot 144 while the key 143 is not inserted in the tumbler housing 141 the logic module 120 will send a notification to the appropriate authority 154.

Figure 6:
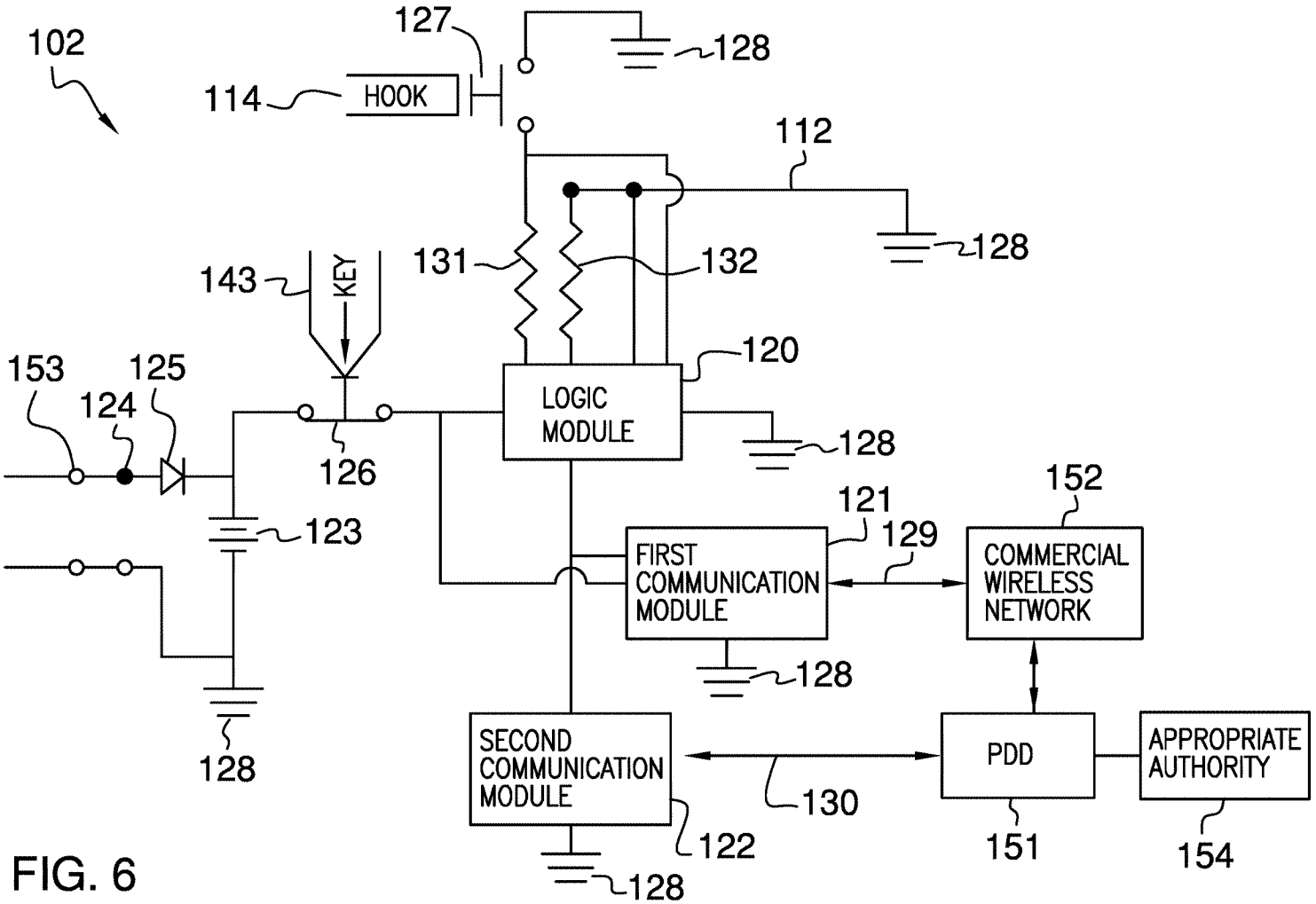
FIG. 6 is a block diagram of an embodiment of the disclosure.

As shown most clearly in FIG. 6, the first pull up resistor 131 is a limit resistor that completes a series between the cable continuity wire 112 and the logic module 120. The first pull up resistor 131 limits current flow through the cable continuity wire 112. The second pull up resistor 132 is a limit resistor that completes a series circuit between the hook switch 127 and the logic module 120. The second pull up resistor 132 limits current flow through the hook switch 127.

The port cover 133 is a barrier that is placed over the charging port 124 for the purpose of protecting the charging port 124.

Figure 7:
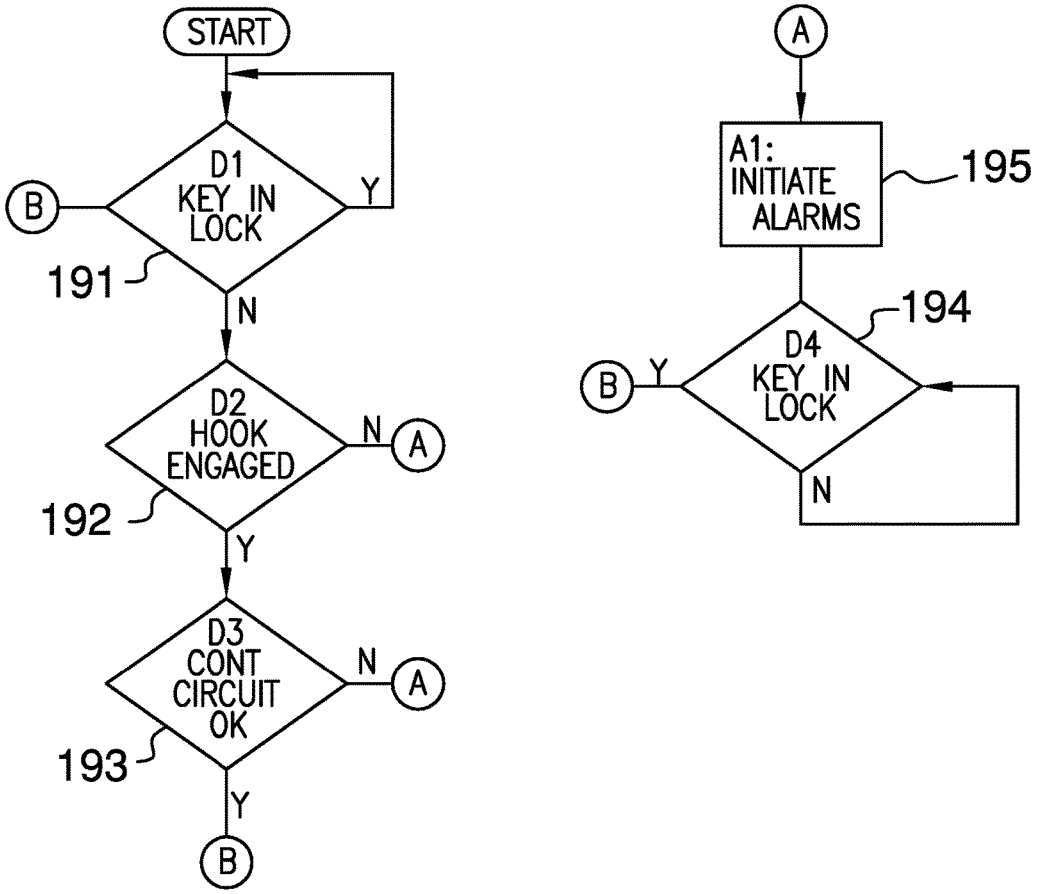
FIG. 7 is a flowchart of an embodiment of the disclosure.

As shown most clearly in FIG. 7, the operation of the control system 102 is described in the following 4 paragraphs.

The logic module 120 makes a first decision 191 to determine whether the key 143 is inserted into the tumbler housing 141. If the key 143 is inserted into the tumbler housing 141 then the logic module 120 loops back to the first decision 191. If the key 143 is not inserted into the tumbler housing 141 then the logic module 120 makes a second decision 192 to determine whether the hook 114 is inserted in the hook slot 144.

If the hook 114 is not inserted into the hook slot 144 then the logic module 120 takes the first action 195 of initiating the alarms. The logic module 120 initiates the alarms by issuing one or more notifications to the appropriate authority 154 using a module selected from the group consisting of the first communication module 121 and the second communication module 122. After the first action 195 is completed the logic module 120 makes a fourth decision 194 to determine whether the key 143 is inserted into the tumbler housing 141. If the key 143 is not inserted into the tumbler housing 141 then the logic module 120 loops back to the fourth decision 194. If the key 143 is inserted into the tumbler housing 141 then the logic module 120 loops back to the first decision 191 to restart the process.

If the hook 114 is inserted into the hook slot 144 then the logic module 120 makes a third decision 193 to determine whether the cable continuity wire 112 is intact. If the cable continuity wire 112 is intact then the logic module 120 loops back to the first decision 191. If the cable continuity wire 112 is not intact then the logic module 120 takes the first action 195 of initiating the alarms. After the first action 195 is completed the logic module 120 makes a fourth decision 194 to determine whether the key 143 is inserted into the tumbler housing 141. If the key 143 is not inserted into the tumbler housing 141 then the logic module 120 loops back to the fourth decision 194. If the key 143 is inserted into the tumbler housing 141 then the logic module 120 loops back to the first decision 191 to restart the process.

In the first potential embodiment of the disclosure, the first action 195 comprises using the first communication module 121 to send a notification of tampering as an SMS message to the appropriate authority 154 over the commercially provided and publicly available cellular wireless network 152 using the first wireless communication link 129.

In the second potential embodiment of the disclosure, the first action 195 is the same as the first potential embodiment of the disclosure with the additional action that the second communication module 122 sends a second notification of tampering directly to the personal data device 151 of the appropriate authority 154 using the second wireless communication link 130.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Battery: As used in this disclosure, a battery is a chemical device consisting of one or more cells, in which chemical energy is converted into electricity and used as a source of power.

Bind: As used in this disclosure, to bind is a verb that means to tie or secure a first object to a second object using a cord.

Control System: As used in this disclosure, a control system is a first device or system that manages and regulates the behavior or operation of a second device or system.

Cord: As used in this disclosure, a cord is a long, thin, and flexible piece of string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Diode: As used in this disclosure, a diode is a two terminal semiconductor device that allows current flow in only one direction. The two terminals are called the anode and the cathode. Electric current is allowed to pass from the anode to the cathode.

Electrical Ground: As used in this disclosure, an electrical ground is a common reference voltage that is used in the design and implementation of electrical circuits. An electrical ground is often, but not necessarily, the discharge point of electric currents flowing through an electric circuit.

External Power Source: Refers to source of the energy that is externally provided to enable the operation of the present disclosure. Examples of external power sources include, but are not limited to, electrical power sources and compressed air sources.

Hook: As used in this disclosure, a hook is an object that is curved or bent at an angle such that items can be hung on or caught by the object.

Limit Resistor: As used in this disclosure, a limit resistor is an electrical resistor that is used to limit the flow of electric current through an electrical circuit.

Lock: As used in this disclosure, a lock is a fastening device that is released through the use of a key, a numeric or alphanumeric combination, or a biometric identification protocol.

Logic Module: As used in this disclosure, a logic module is a readily and commercially available electrical device that is programmable and that accepts digital and analog inputs, processes the digital and analog inputs according to previously stored instruction and provides the results of these instructions as digital or analog outputs.

Loop: As used in this disclosure, a loop is the length of a first linear structure including, but not limited to, shafts, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Momentary Switch: As used in this disclosure, a momentary switch is a biased switch in the sense that the momentary switch has a baseline position that only changes when the momentary switch is actuated (for example when a pushbutton switch is pushed). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

PDD: As used in this disclosure, PDD is an acronym for personal data device.

Personal Data Device: As used in this disclosure, a personal data device is a handheld device that is used for managing personal information and communication. Examples of personal data device include, but are not limited to, cellular phones, tablets and smart phones.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Pull Up Resistor: As used in this disclosure, a pull up resistor is an electrical resistor that is used to: 1) limit the current flow through a switching device; and, 2) to control the voltage level presented across a load resistor, a pull down resistor or an open circuit.

SMS: As used in this disclosure, SMS is an abbreviation for short message service. The short message service is a service that is often provided with the cellular services that support personal data devices. Specifically, the SMS allows for the exchange of written messages between personal data devices. The SMS is commonly referred to as text messaging. A common enhancement of SMS is the inclusion of the delivery of multimedia services. This enhanced service is often referred to as Multimedia Media Services which is abbreviated as MMS.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors.

WiFi: As used in this disclosure, WiFi refers to the physical implementation of a collection of wireless electronic communication standards commonly referred to as IEEE 802.11x.

Wire: As used in this disclosure, a wire is a structure with the general appearance of a cord or strand that is formed from a metal and is electrically conductive.

Wireless: As used in this disclosure, wireless is an adjective that is used to describe a communication channel between two terminals that does not require the use of physical cabling.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A security device comprising:

a lock member and a control system;

wherein the control system attaches to the lock member;

wherein the security device is configured for use with an object;

wherein the security device binds the object in a manner selected from the group consisting of: 1) anchoring the object to an anchor point; or, 2) binding the object to itself for the purpose of incapacitating the object;

wherein the lock member binds the object;

wherein the control system monitors the lock member;

wherein the control system generates a notification to an appropriate authority;

wherein the lock member comprises a security cable, a cable continuity wire, and a lock;

wherein the cable continuity wire is incorporated into the security cable;

wherein the security cable attaches to the lock member;

wherein the security cable is a flexible cable;

wherein the security cable is formed from a hardened steel;

wherein the security cable comprises a hook;

wherein the security cable is further defined with a first end and second end;

wherein the hook attaches to the second end of the security cable;

wherein the cable continuity wire is an electrically conductive wire;

wherein the cable continuity wire senses tampering with the security cable;

wherein the lock member is a fastening device;

wherein the lock attaches the first end of the security cable to the second end of the security cable thereby forming a loop in the security cable;

wherein the loop binds the object;

wherein the lock comprises a tumbler housing, a circuit housing, a key, and a hook slot;

wherein the circuit housing attaches to the tumbler housing;
wherein the hook slot attaches to the tumbler housing;
wherein the key is inserted into the tumbler housing;
wherein the tumbler housing further comprises a plurality of tumblers;
wherein the first end of the security cable is permanently attached to the tumbler housing;
wherein the tumbler housing is a first rigid structure;
wherein the plurality of tumblers are contained within the tumbler housing;
wherein the key is a device that is inserted into and rotated within the tumbler housing;
wherein the key adjusts the plurality of tumblers such that the lock is adjusted between a locked position and an unlocked position;
wherein the circuit housing is a second rigid structure;
wherein the control system is contained within the circuit housing;
wherein the hook slot is an aperture that is formed within the tumbler housing;
wherein the hook is removably inserted into the hook slot;
wherein the hook is matched to the hook slot such that the hook is secured within the hook slot when the lock is in the locked position;
wherein the hook remains attached to the hook slot until the lock is released;
wherein the control system is an electrically powered device;
wherein the control system monitors the lock for tampering;
wherein the control system sends one or more wireless notifications to the appropriate authority;
wherein the control system comprises a logic module, a first communication module, a battery, a charging port, a diode, a key switch, a hook switch, an electrical ground, a first wireless communication link, a first pull-up resistor, and a second pull-up resistor;
wherein the logic module, the first communication module, the battery, the charging port, the diode, the key switch, the hook switch, the electrical ground, the first wireless communication link, the first pull-up resistor, and the second pull-up resistor are electrically interconnected;
wherein the electrical ground is a reference voltage;
wherein the logic module generates and monitors an electrical current that flows through the cable continuity wire.

2. The security device according to claim 1
wherein the first communication module is a first wireless communication device;
wherein the first communication module exchanges SMS and MMS based notifications between the logic module and the appropriate authority through a commercially provided and publicly available cellular wireless network;
wherein the first communication module creates the first wireless communication link to communicate with the commercially provided and publicly available cellular wireless network.

3. The security device according to claim 2
wherein the key switch is a normally closed momentary switch;
wherein the key switch is monitored by the logic module;
wherein when the key is inserted into the tumbler housing, the key switch is opened.

4. The security device according to claim 3
wherein the hook switch is a normally open momentary switch;
wherein the hook switch is monitored by the logic module;
wherein when the hook is inserted into the hook slot, the hook switch is closed.

5. The security device according to claim 4
wherein the first pull-up resistor is a limit resistor;
wherein the first pull-up resistor completes a series between the cable continuity wire and the logic module;
wherein the first-pull up resistor limits current flow through the cable continuity wire;
wherein the second pull-up resistor is a limit resistor that completes a series circuit between the hook switch and the logic module;
wherein the second pull-up resistor limits current flow through the hook switch.

6. The security device according to claim 5
wherein the battery is rechargeable battery;
wherein the charging port is an electrical circuit that reverses the polarity of the battery;
wherein the charging port attaches to an external power source from which it draws electrical energy;
wherein the plug refers to an electrical termination that provides power to the battery;
wherein the diode is an electrical device that allows current to flow in only one direction;
wherein the diode is installed between the battery and the charging port such that electricity will not flow from the positive terminal of the battery to the positive terminal of the charging port.

7. The security device according to claim 6 wherein the logic module is a programmable device.

8. The security device according to claim 7
wherein the security device further comprises a second communication module and a second wireless communication link;
wherein the second communication module sends a notification from the logic module to and a locally-presented device provided by the appropriate authority;
wherein the second communication module creates the second wireless communication link to communicate with the locally presented device.

9. The security device according to claim 6
wherein the logic module is a programmable device;
wherein the logic module makes a first decision to determine whether the key is inserted into the tumbler housing;
wherein the logic module makes a second decision to determine whether the hook is inserted in the hook slot;
wherein the logic module makes a third decision to determine whether the cable continuity wire is intact;
wherein the logic module takes a first action of issuing a first notification to the appropriate authority through the first communication module.

10. The security device according to claim 9
wherein the object is a cycle selected from the group consisting of a bicycle or motorcycle;
wherein the cycle is further defined with a wheel;
wherein the security device further comprises a second communication module and a second wireless communication link;
wherein the second communication module sends a notification from the logic module to and a locally-presented device provided by the appropriate authority;

wherein the second communication module creates the second wireless communication link to communicate with the locally presented device;

wherein the logic module takes a second action of issuing a second notification to the appropriate authority through the second communication module.

* * * * *